US005425626A

United States Patent [19]

Tojo et al.

[11] Patent Number: 5,425,626

[45] Date of Patent: Jun. 20, 1995

[54] SCROLL TYPE FLUID MACHINE WITH AN INVOLUTE SPIRAL BASED ON A CIRCLE HAVING A VARYING RADIUS

[75] Inventors: Kenji Tojo, Ibaraki; Hideyuki Ueda, Shimizu, both of Japan

[73] Assignee: Hitachi, Ltd., Tokyo, Japan

[21] Appl. No.: 119,385

[22] Filed: Sep. 13, 1993

[30] Foreign Application Priority Data

Sep. 11, 1992 [JP] Japan ..... 4-243029
Nov. 11, 1992 [JP] Japan ..... 4-300804

[51] Int. Cl.[6] ..... F01C 1/04
[52] U.S. Cl. ..... 418/55.2; 418/150
[58] Field of Search ..... 418/55.2, 150

[56] References Cited

U.S. PATENT DOCUMENTS 4,627,800 12/1986 Matsudaira et al. ..... 418/55.2
4,856,973 8/1989 Hirano et al. ..... 418/55.2

FOREIGN PATENT DOCUMENTS 57-73803 5/1982 Japan .
60-252102 12/1985 Japan .
1-63680 3/1989 Japan ..... 418/55.2
4-54201 2/1992 Japan ..... 418/55.2

*Primary Examiner*—John J. Vrablik
*Attorney, Agent, or Firm*—Antonelli, Terry, Stout & Kraus

[57] ABSTRACT

A scroll type fluid machine including two scroll members, each having a spiral body formed on a base plate, which are arranged to make their spiral bodies mesh with each other to form a confined space therebetween, one of said scroll members being arranged to make an orbiting movement relatively to the other scroll member to successively enlarge or reduce said confined space to expand or contract a fluid confined in said space, wherein said spiral body has a shape formed by an involute based on a circle having a radius which varies in accordance with an involute angle.

15 Claims, 9 Drawing Sheets fa'(λ)>0 fa'(λ)<0

SCROLL TYPE FLUID MACHINE WITH AN INVOLUTE SPIRAL BASED ON A CIRCLE HAVING A VARYING RADIUS

BACKGROUND OF THE INVENTION

FIELD OF THE INVENTION

The present invention relates to a scroll type fluid machine, namely volume type fluid machines used for a compressor, a vacuum pump, an expander or the like and, more particularly, a scroll type fluid machine suitable to provide a high performance and a high reliability in various uses.

The fundamental principle of the scroll type fluid machine is well known. As a shape of a spiral wrap of the scroll type fluid machine, an involute shape based on a circle having a constant diameter as shown in FIG. 6 has been commonly used since it is easy for machining. Japanese Patent Application Laid-Open No. SHO 57-73803 shows an example of such scroll type fluid machines.

Fundamental elements of the scroll type fluid machine of this type include a fixed scroll and an orbiting scroll, each of which has a same spiral shape consisting of an involute based on a same circle having a constant diameter, a suction port formed in the fixed scroll at the outside of the orbiting scroll, a discharge port formed in the fixed scroll at a central part thereof, a rotation preventing mechanism for preventing rotation of the orbiting scroll to cause an orbiting movement of the orbiting scroll relative to the fixed scroll and a driving mechanism for driving the orbiting scroll.

Japanese Patent Application Laid-Open No. SHO 60-252102 discloses a construction of the scroll type fluid machine of this kind in which a thickness of the spiral wrap continuously varies from its starting end to its terminating end.

In the conventional scroll type fluid machine in which a spiral body of each scroll is formed by an involute curve based on a circle having a constant radius, a freedom in determining the spiral shape of the wrap is limited when a radius of a base circle, an involute angle, a thickness of the wrap and a height of the wrap are determined, and a stroke volume (a volume at the time when a confinement effected by an outermost part of the wrap has been completed) and a built-in volume ratio (inner volume ratio) are determined thereby. Thus, there are problems as hereafter described.

In case of a compressor for a refrigerator which is operated under the conditions where a ratio (pressure ratio) between a suctioning pressure and a discharge pressure is high, the built-in volume ratio must be high and, in order to secure a high built-in volume ratio, a winding angle must be larger, thereby resulting in increasing an external size of the compressor. If the winding angle is increased while the external size and the height of the spiral body are held at predetermined values, the thickness of a plate of the spiral body is reduced and, consequently, a strength is lowered or the stroke volume is reduced.

In general, a pressure difference between operating chambers becomes higher toward a central part where a fluid is compressed and a pressure of the fluid is increased. In case of the conventional scroll type fluid machine as described above, the thickness of plate of the spiral body is uniform and, therefore, in order to compensate for the lowering of the strength it is necessary to uniformly decrease the height of the plate thickness of the spiral body or uniformly increase the plate thickness of the spiral body. Accordingly such problems occur that some part becomes unnecessarily thick or the size of radius becomes unnecessarily large.

In a scroll type fluid machine as shown in the Japanese Patent Application Laid-Open No. SHO 60-252102, the thickness of the spiral wrap varies from its starting end to its terminating end, but it has been found that no consideration is given to a phase or other conditions, so that the fixed scroll and the orbiting scroll have different curves. Therefore, it is necessary to effect machining of the orbiting scroll and the fixed scroll according to different machining programs. There is another problem in that a contact point between an outer line of the spiral wrap of the orbiting scroll and an inner line of the spiral wrap of the fixed scroll is located at a position out of a tangential line relative to the base circle and, therefore, a complete sealing point is not always obtained. There is a further problem in that a groove width of the spiral body varies, depending upon the winding angle and, therefore, it is necessary, at the time of machining the spiral body by means of an end mill, to separately effect machining of the inside surface and the outside surface of the spiral body and to effect a plurality of machining steps to form a bottom surface of the groove, depending upon a variation of the width of the groove. Otherwise, the spiral body cannot be precisely manufactured. Thus the number of machining steps is increased.

SUMMARY OF THE INVENTION

It is a general object to eliminate the problems of the conventional scroll type fluid machines as described above.

It is a specific object of the present invention to provide a scroll type fluid machine which increases a freedom in design of the machine relating to a built-in volume ratio, a stroke volume, a plate-thickness of a spiral body and the like.

It is another object of the present invention to provide a scroll type fluid machine which has an optimum shape for respective uses.

In order to attain the objects as described above, the present invention provides a scroll type fluid machine including two scroll members, each having a spiral body formed on a base plate, which are arranged to make their spiral bodies mesh with each other to form a confined space therebetween, with one of the scroll members being arranged to make an orbiting movement relative to the other scroll member to successively enlarge or reduce the confined space to expand or contract a fluid confined in the space. The spiral body has a shape formed by an involute based on a circle having a radius which varies in accordance with an involute angle and an outer line and an inner line of the spiral body have phase differences relatively to the involute angle.

The present invention further provides a scroll type fluid machine of the above type, wherein the spiral body has a shape formed by an involute based on a circle having a radius which varies in accordance with an involute angle, and the shapes of the spiral bodies of the meshing scrolls are partly or wholly formed in a same shape.

The present invention further provides a scroll type fluid machine of the above kind, wherein the spiral body has a shape formed by an involute based on a circle having a radius which varies in accordance with an involute angle, and an outside shape and an inside shape of said spiral body are formed so as to satisfy the following relationships:

$$a_o = f(\lambda),$$

$$a_i = f(\lambda - \pi),$$

where:

$a_o$=a radius of base circle of involute which forms outside shape of the spiral body, $a_i$=a radius of base circle of involute which forms inside shape of the spiral body, and $\lambda$=involute angle.

The present invention further provides a scroll type fluid machine of the above type, wherein the spiral body has a shape formed by an involute based on a circle having a radius which varies in accordance with an involute angle, and the spiral body is formed so as to satisfy the following relationships Assuming that a is a radius of a base circle of the involute which forms the shape of the spiral body, $\lambda$ is an involute angle and the involute is expressed by X-coordinate and Y-coordinate, the radius of base circle is $$a = f(\lambda) = as + \Delta\lambda$$

the shape of outer line of spiral body is $$X_{mo} = f(\lambda)\cos\lambda + \{f(\lambda)\lambda + \tfrac{1}{2}(t_O + \Delta a\pi\lambda)\}\sin\lambda,$$

$$Y_{mo} = f(\lambda)\sin\lambda - \{f(\lambda)\lambda + \tfrac{1}{2}(t_O + \Delta a\pi\lambda)\}\cos\lambda, \text{ and}$$

the shape of inner line of spiral body is $$X_{mi} = f(\lambda - \pi)\cos\lambda + \}f(\lambda - \pi)\lambda - \tfrac{1}{2}(t_O + \Delta a\pi(\lambda - \pi))\}\sin\lambda,$$

$$Y_{mi} = f(\lambda - \pi)\sin\lambda - \{f(\lambda - \pi)\lambda - \tfrac{1}{2}(t_O + \Delta a\pi(\lambda - \pi))\}\cos\lambda.$$

The present invention further provides a scroll type fluid machine of the above type, wherein the spiral body has a shape formed by an involute based on a circle having a radius which varies in accordance with an involute angle, and the spiral body is formed as so to satisfy the following relationships, assuming that an outer line of the spiral body and an inner line of the spiral body have a common radius of base circle a=f ($\lambda$p), and an involute angle of a point P on the outer line is $\lambda_p$ and an involute angle of a point Q on the inner line is $\lambda_g$:

$$\lambda_g = \lambda_p + \pi$$

The present invention further provides a scroll type fluid machine of the above type, wherein the spiral body has a shape formed by an involute based on a circle having a radius which varies in accordance with an involute angle, and lines connecting a plurality of contact points and said base circle are common to both of said scrolls.

The present invention further provides a scroll type fluid machine including two scroll members, each having a spiral body formed on a base plate, which are arranged to make their spiral bodies mesh with each other to form a confined space therebetween, one of the scroll members being arranged to make an orbiting movement relatively to the other scroll member to successively enlarge or reduce said confined space to expand or contract a fluid confined in the space, wherein the spiral body is formed such that a groove width between the spiral body vary in accordance with an involute angle and the shapes of spiral bodies of the meshing scroll members are formed in a same shape.

The present invention further provides a scroll type fluid machine of the above type, wherein the spiral body is so formed that a part of the shape is formed so as to vary a groove width between the spiral bodies and a thickness of the spiral body vary in accordance with an involute angle while the remaining part of the shape is formed so as to provide constant groove width and constant thickness relatively to the involute angle, and the shapes of the spiral bodies of both scroll members are formed in a same shape.

The present invention further provides a scroll type fluid machine of the above type, the spiral body is so formed that a part of the shape of the spiral body is formed by an involute based on a circle having a radius which varies in accordance with an involute angle while the remaining part of the shape of the spiral body is formed by an involute based on a circle having a constant radius, and wherein the shapes of the spiral bodies of both scroll members are formed in substantially the same shape.

The present invention further provides a scroll type fluid machine of the above type, wherein the inside shape and the outside shape of the spiral body consist of involute based on circles having different radii at a same involute angle, respectively. Further the present invention provides a scroll type fluid machine of the above type characterized in that the spiral body is formed so as to satisfy the following relationships:

$$a_o = f(\lambda),$$

$$a_i = f(\lambda - \pi),$$

where:

$a_o$=a radius of base circle of involute which forms outside shape of the spiral body, $a_i$=a radius of base circle of involute which forms inside shape of the spiral body, $\lambda$=an involute angle.

The present invention further provides a scroll type fluid machine of the above kind characterized in that when said spiral body is formed so as to satisfy the following relationship:

$$\frac{da}{d\lambda} = \frac{df(\lambda)}{d\lambda} = f'(\lambda)$$

where:

a=radius of base circle of said involute, $\lambda$=involute angle, $f'(\lambda)$ increment of radius of the base circle relative to the involute angle, and wherein the increment $f'(\lambda)$ of the radius a of the base circle relative to the involute angle $\lambda$ through the entire or a part of starting end to terminating end of the spiral body satisfies the following relationships:

$$f'(\lambda) < 0.$$

The present invention further provides a scroll type fluid machine of the above type wherein the spiral body is formed so as to satisfy the following relationship:

$$\frac{da}{d\lambda} = \frac{df(\lambda)}{d\lambda} = f'(\lambda)$$

where:

a=radius of base circle of said involute,

λ=involute angle, f'(λ)=increment of radius of the base circle relative to the involute angle, and wherein the increment f'(λ) of the radius a of the base circle relative to the involute angle λ through the entire or a part of starting end to terminating end of the spiral body satisfies the following relationship:

$$f'(\lambda)<0.$$

As described above, the scroll type fluid machine according to the present invention includes two scroll members, each having a spiral body formed on the base plate, which are arranged to make their spiral bodies mesh with each other to form a confined space therebetween, and one of the scroll members is arranged to make an orbiting movement relative to the other scroll member to successively enlarge or reduce the confined space to expand or contact a fluid confined in the space, and this machine is so constructed that the spiral body has a shape formed by an involute based on a circle having a radius which varies in accordance with an involute angle, whereby an outer line and an inner line of the spiral body have phase differences relative to said involute angle. Said spiral body has a shape formed by the involute based on a circle having a radius which varies in accordance with the involute angle. An outside shape and an inside shape of said spiral body are formed so as to satisfy the following relationships:

$$a_o=f(\lambda),\ a_i=(\lambda-\pi)$$

where:

$a_o$=a radius of base circle of involute which forms outside shape of the spiral body, $a_i$=a radius of base circle of involute which forms inside shape of the spiral body, λ=an angle involute angle.

The spiral body has a shape formed by an involute based on a circle having a radius which varies in accordance with an involute angle, and the spiral body is formed so as to satisfy the following relationships, assuming that a is a radius of a base circle of the involute which forms the shape of the spiral body, λ is an involute angle land the involute is expressed by X-coordinate and Y-coordinate:

the radius of base circle is $$a=f(\lambda)=as+\Delta a\lambda,$$

the shape of outer line of spiral body is $$X_{mo}=f(\lambda)\cos\lambda+\{f(\lambda)\lambda+\tfrac{1}{2}(t_O+a\pi\lambda)\}\sin\lambda,$$

$$Y_{mo}=f(\lambda)\sin\lambda-\{f(\lambda)\lambda+\tfrac{1}{2}(t_O+\Delta a\pi\lambda)\}\cos\lambda,$$

and the shape of inner line of spiral body is:

$$X_{mi}=f(\lambda-\pi)\cos\lambda+\{f(\lambda-\pi)\lambda-\tfrac{1}{2}(t_O+\Delta a\pi(\lambda-\pi))\}\sin\lambda,$$

$$Y_{mi}=f(\lambda-\pi)\sin\lambda-\{f(\lambda-\pi)\lambda-\tfrac{1}{2}(t_O+\Delta a\pi(\lambda-\pi))\}\cos\lambda.$$

The spiral body has a shape formed by an involute based on a circle having a radius which varies in accordance with an involute angle, and said spiral body is formed so as to satisfy the following relation: assuming that an outer line of the spiral body and an inner line of the spiral body have a common radius of base circle a=f(Ap), and an involute angle of a point P on the outer line is $\lambda_p$ and an involute angle of a point Q on the inner line is $\lambda_g$ wherein:

$$\lambda_g\lambda_p+\pi.$$

The spiral body has a shape formed by an involute based on a circle having a radius which varies in accordance with an involute angle, and line connecting a plurality of contact points and the base circle are common to both of the scrolls. The inside shape and the outside shape of the spiral body consist of involute based on circles having different radii at a same involute angle, respectively. The spiral body is formed so as to satisfy the following relationships $$a_O=f(\lambda),$$

Accordingly, a difference in phase exists therebetween, so that even when the spiral body is formed by the involutes based on the circles having radii which vary in accordance with the involute angle, with the orbiting scroll and the fixed scroll contacting at a plurality of contact points and arranged so that the lines connecting the base circle and the contact points are common to both scrolls and thus the spiral bodies have seal points at the positions normal to the respective side surfaces.

According to the present invention, the shape of the spiral body is formed by an involute based on a circle having a radius which varies in accordance with an involute angle and the shapes of the spiral bodies of the meshing scrolls consist of same shape through a part or a whole thereof. Accordingly, the spiral bodies of the orbiting scroll and the fixed scroll can be made by a same machining program, that provides a good productivity.

Furthermore, according to the present invention, when said spiral body is formed so as to satisfy the following relationships:

$$\frac{da}{d\lambda} = \frac{df(\lambda)}{d\lambda} = f'(\lambda)$$

where:

a=radius of base circle of said involute,

λ=involute angle, f'(λ)=increment of radius of the base circle relative to the involute angle, and wherein the increment f'(λ) of the radius a of the base circle relative to the involute angle λ through the entire or a part of starting end to terminating end of the spiral body satisfies the following relationships:

$$f'(\lambda)<0.$$

Accordingly, as the involute angle λ is increased, so that the position is displaced toward the outside of the spiral body, the thickness of the spiral body is decreased. Therefore, if the confined volume of the outermost chamber among the plurality of operating chambers formed between the spiral bodies is set at an equal volume, the outer diameters of both scrolls can be decreased, as compared to the conventional construction which uses the spiral body consisting of the involute based on the circle having a constant radius. On the other hand, if the outer diameter is set at the same degree, the winding number of the spiral body can be increased, as compared to the conventional construction in which the spiral body consisting of the involute based on relationship:

$$\frac{da}{d\lambda} = \frac{df(\lambda)}{d\lambda} = f'(\lambda)$$

where:

a=radius of base circle of said involute,

λ=involute angle, f'(λ)=increment of radius of the base circle relative to the involute angle, and wherein the increment f'(λ) of the radius a of the base circle relative to the involute angle λ through the whole or a part of starting end to terminating end of the spiral body satisfies the following relationship:

$$f'(\lambda)>0.$$

Accordingly, the thickness of the spiral body becomes thicker as the spiral body extends toward the outer side; therefore, if the number of windings of the spiral body is held at constant, the ratio (built-in volume ratio) of the confined volume at the outermost part versus the confined volume at the innermost chamber is increased, as compared to the conventional construction in which the involute is based on a circle having a constant radius, this construction is suitable for the use in the case where the operation is effected at higher pressure ratio. The spiral body is formed such that a groove width between the spiral bodies and a thickness of the spiral body vary in accordance with an involute angle and the shapes of the spiral bodies of the meshing scroll members are formed in a same shape, or a part of the shape of the spiral body is formed by an involute based on a circle having radius which varies in accordance with an involute angle of the spiral body while the remaining part of the shape of the spiral body is formed by an involute having a radius which is constant relatively to the involute angle of the spiral body and the shapes of the spiral bodies of the meshing scroll members are formed in substantially same shape. Therefore, the scrolls can be easily machined.

The invention will be hereinafter described with reference to the embodiments as illustrated in the accompanying drawings.

DETAILED DESCRIPTION OF THE PREFERRED EMBODIMENTS

Now the present invention will be explained, with reference to FIGS. 1–8 which illustrate the preferred embodiments of the invention.

Figure 1:
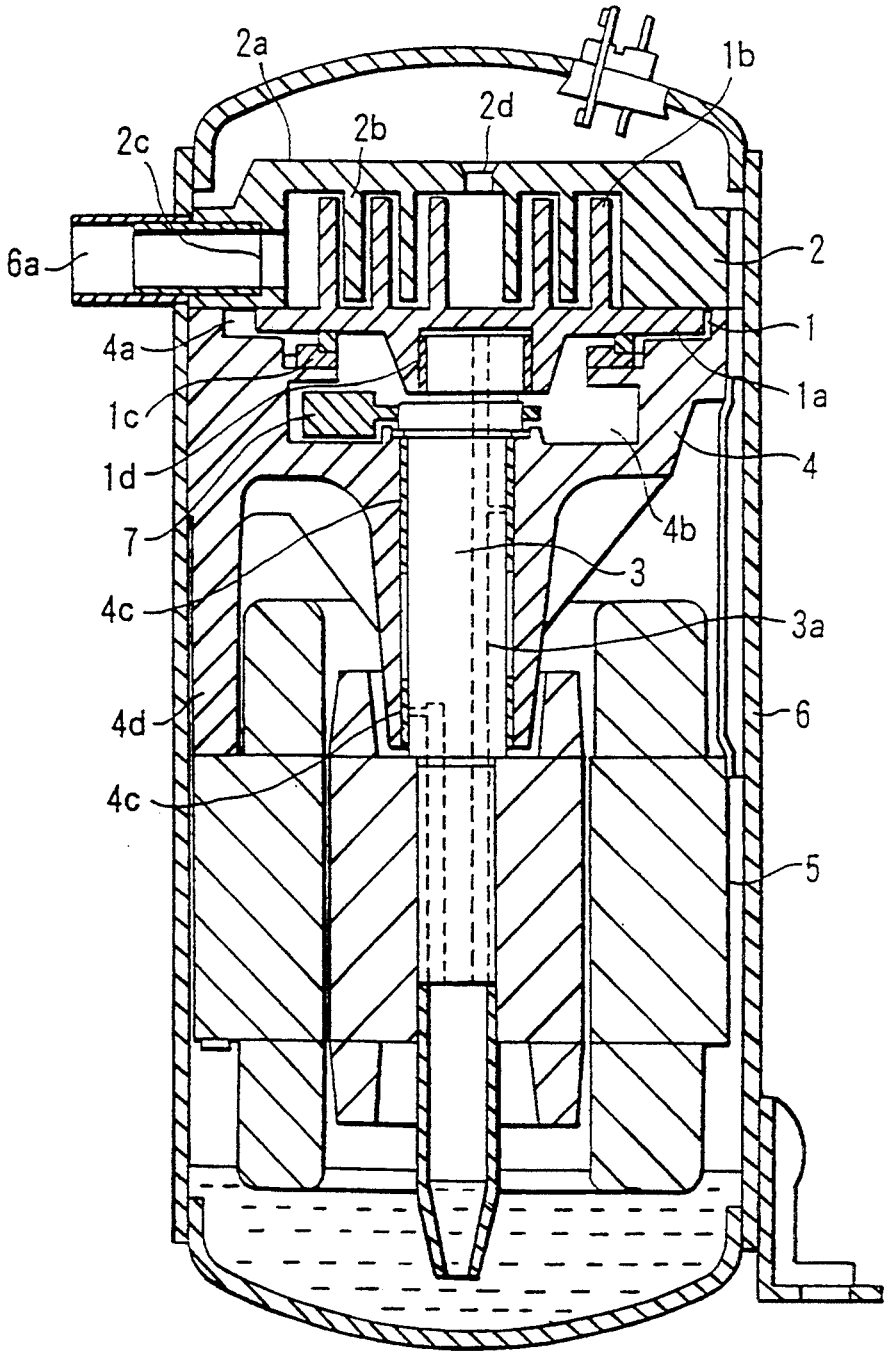
FIG. 1 is a longitudinal section of a scroll compressor according to an embodiment of the present invention.
Figure 2:
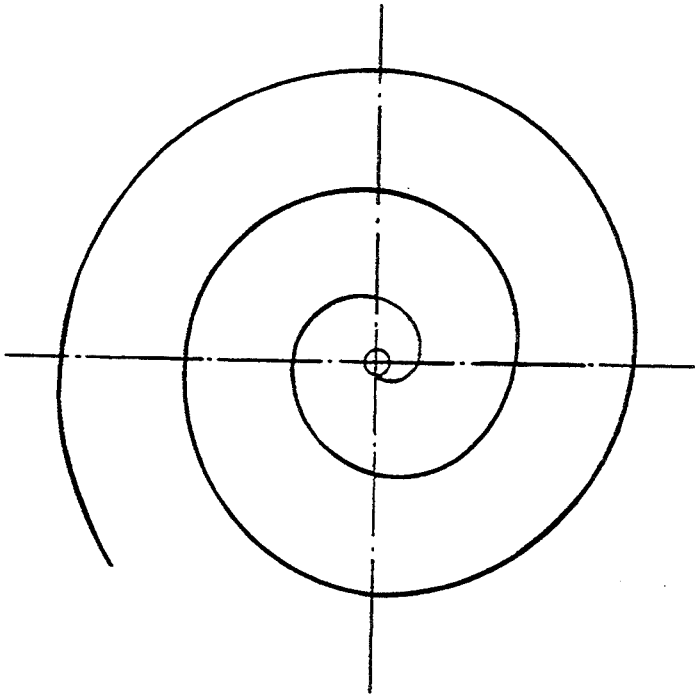
FIG. 2 illustrates an involute based on a circle according to the embodiment of the invention where f'(λ)>0.
Figure 3:
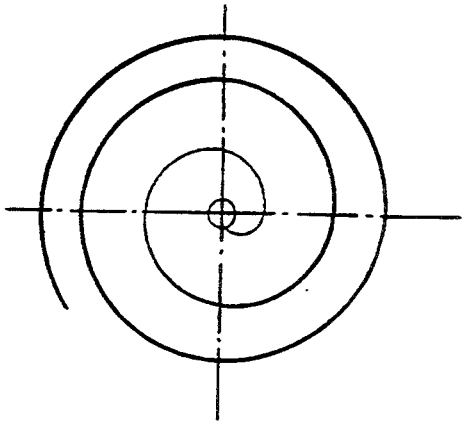
FIG. 3 illustrates an involute based on a circle according to the embodiment of the invention, where f'(λ)>0.
Figure 4:
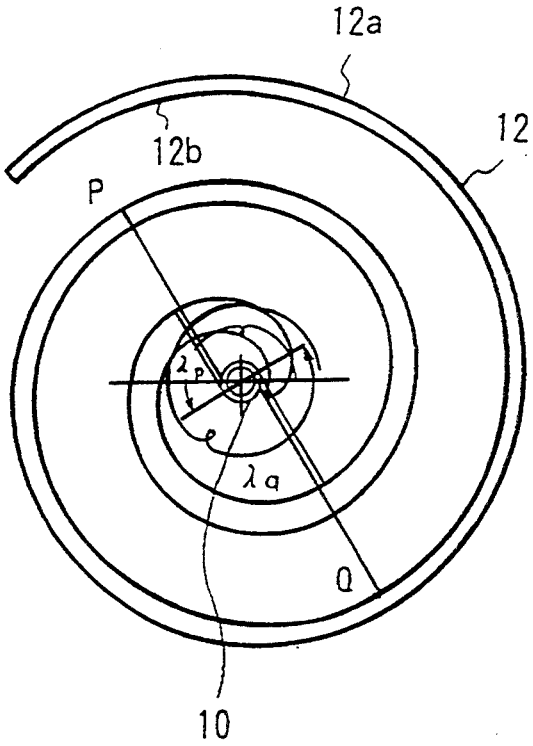
FIG. 4 is a plan view showing a shape of a spiral body.
Figure 5:
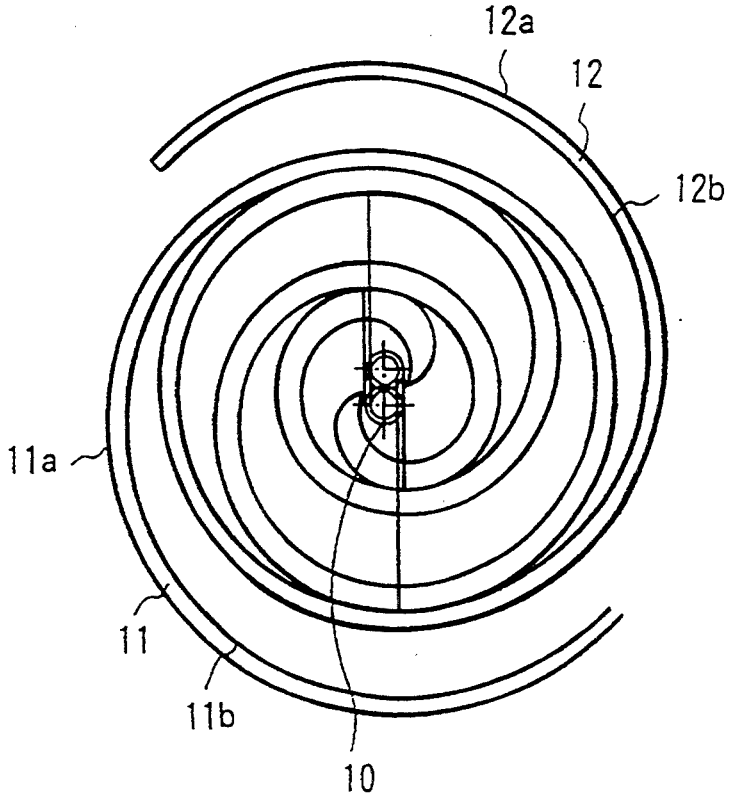
FIG. 5 is a plan view showing a set of spiral which are assembled together.
Figure 6:
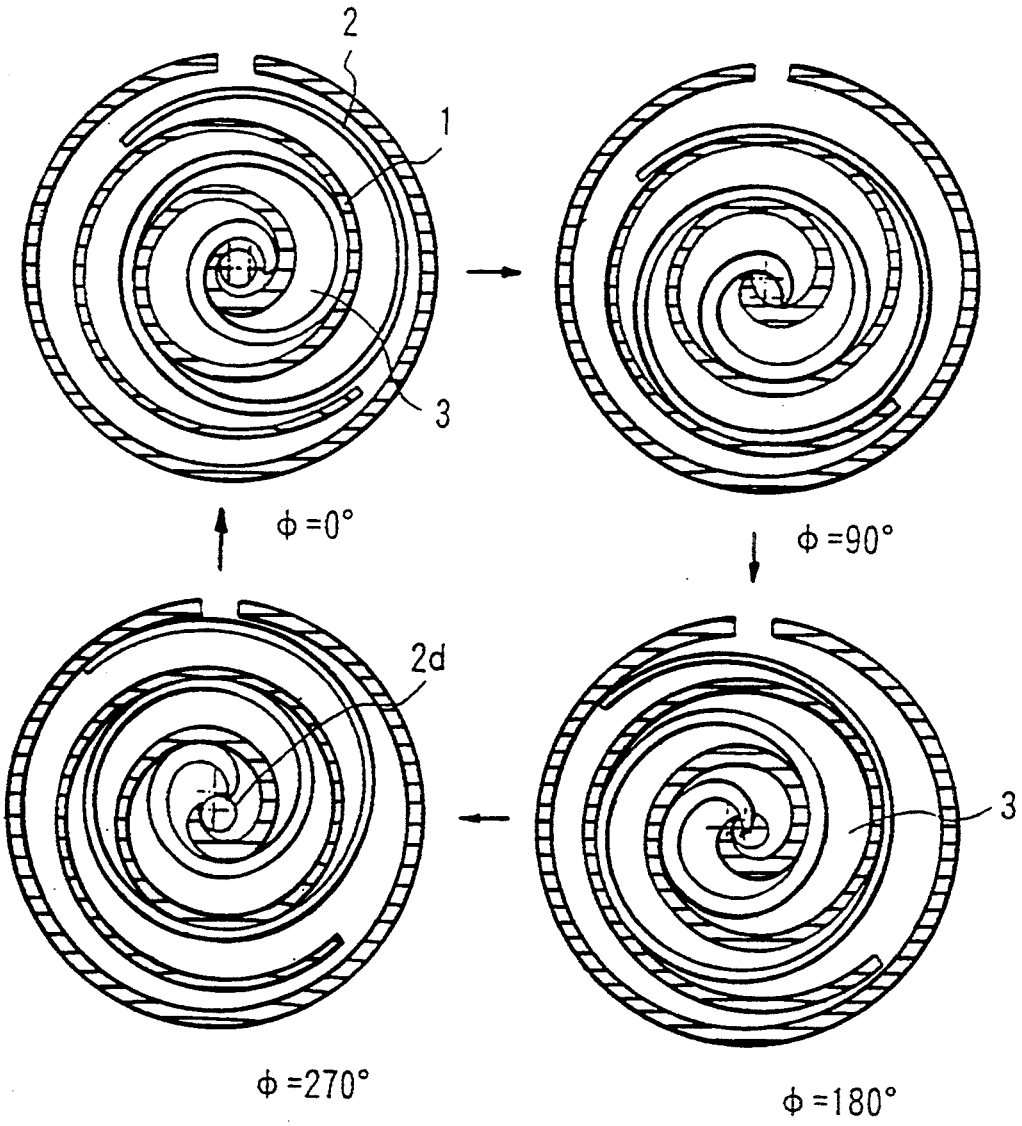
FIG. 6 illustrates a fundamental principle of operation of the spiral bodies shown in FIG. 5.
Figure 7:
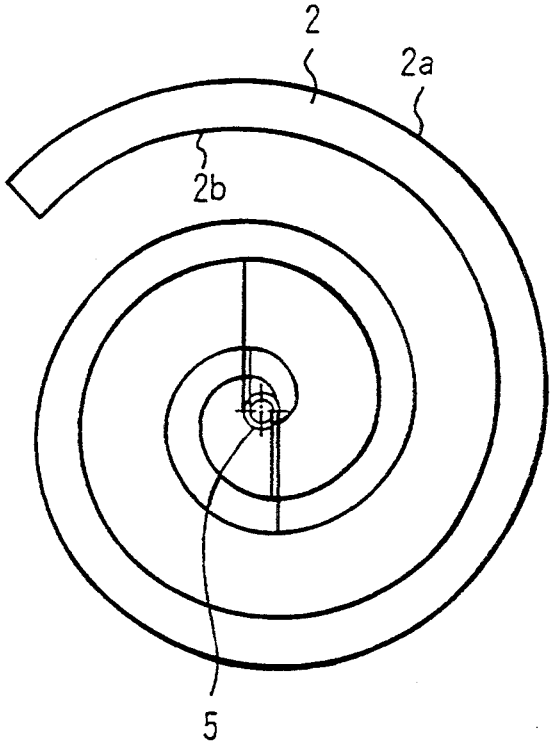
FIG. 7 is a plane view showing a shape of the spiral body.
Figure 8:
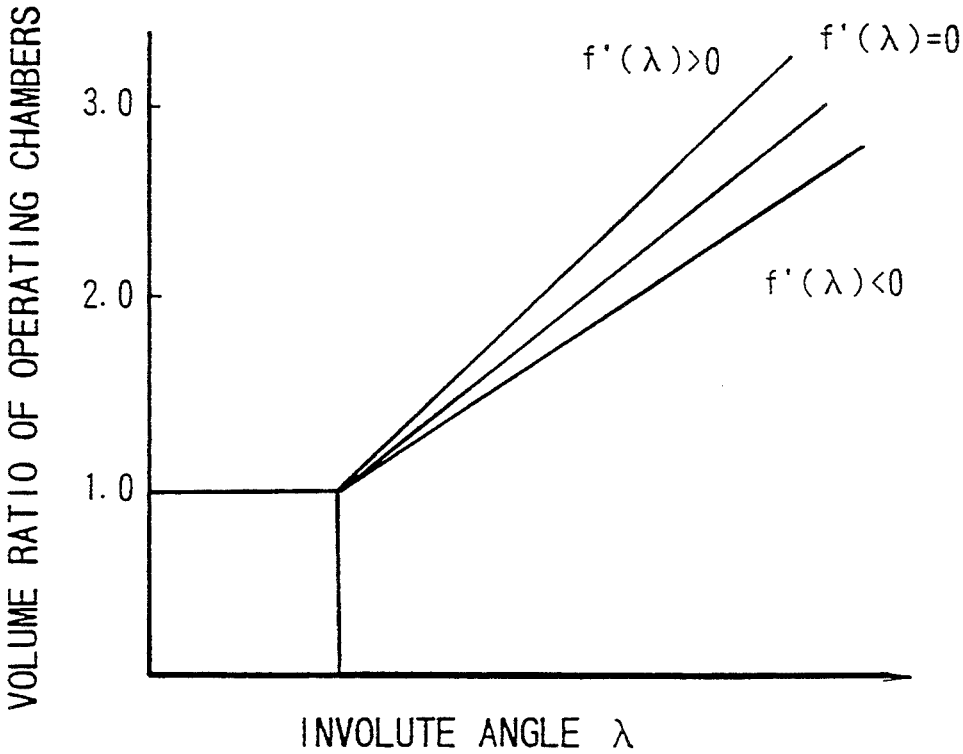
FIG. 8 illustrates a relation of volume change of the spiral bodies.

FIG. 1 is a longitudinal section of a closed scroll compressor according to an embodiment of the invention; FIGS. 2 and 3 illustrate an involute based on a circle according to the embodiment of the invention; FIG. 4 is a plan view showing a spiral body; FIG. 5 is a plan view showing a set of spiral bodies which are assembled together; FIG. 6 illustrates a fundamental principle of the spiral bodies shown in FIG. 5; FIG. 7 is a plane view showing a shape of the spiral bodies; and FIG. 8 illustrates a relation of a change of volume.

As shown in FIG. 1, the closed scroll compressor includes a scroll type compressing mechanism portion consisting of an orbiting scroll 1 and a fixed scroll 2, which are arranged to direct their wraps to the inside to make them mesh with each other and arranged to produce orbiting movement relatively to each other, a crankshaft 3 and a frame 4 connected to said fixed scroll 2; a motor 5 for driving said compressing mechanism portion and a closed vessel 6 housing said compressing mechanism portion and said motor. The orbiting scroll 1 has a base plate 1*a* and a spiral wrap 1*b* formed on said base plate. A rotation preventing mechanism 1*c*, such as an Oldham ring mechanism, for example, for preventing a rotation of the orbiting scroll around its own axis and a bearing 1*d* for receiving a crank portion of the crankshaft 3 are formed in the rear surface of the orbiting scroll. The fixed scroll 2 has a base plate 2*a* and a wrap 2*b* formed on said base plate. A suction port 2*c* and a discharge port 2*d* are formed in the fixed scroll 2. A rear chamber 4*b* is formed by the frame 4 on the rear surface of the orbiting scroll 1. The rear chamber 4*b* is communicated through a pressure equalizing passage (not shown) formed in the base plate 1*a* of the fixed scroll 1 with a compressing chamber formed by the wraps and the base plates of the orbiting scroll 1 and the fixed scroll 2. The frame 4 is formed with a main bearing 4*c* for bearing the crankshaft 3 and a post 4*d* for bearing the motor 5. The crankshaft 3 has an oil feeding passage 3*a* formed therein and an oil contained in the bottom of the closed vessel 6 is fed through said feeding passage to the rotating bearing 1*d* and the main bearing 4*c*.

In the closed scroll compressor as constructed above, the orbiting scroll 1 and the fixed scroll produce orbiting movement relatively to each other under the action of the crankshaft 3 and the rotation preventing mechanism 1c by the rotation of the motor 5. As the compressing chamber formed by both scrolls displaces toward the center, the volume of the compressing chamber is successively decreased. As shown in FIG. 6, the orbiting scroll 2 produces an orbital motion relatively to the fixed scroll 1 around the center of said fixed scroll, while holding the attitude of the orbiting scroll unchanged, through the positions where the crank angle $\phi=0$, $\phi=90$ °, $\phi=180°$ and $\phi=270°$ as indicated in FIG. 6, that is, the orbiting scroll produces an orbital motion with a predetermined radius $\epsilon$. A confined space having a crescent shape formed between both scrolls (hereinafter referred to as "operating chamber") gradually reduces its volume in accordance with the orbital motion of the orbiting scroll, whereby a fluid, suctioned into the operating chamber from the suction port 2c, is compressed and discharged into the closed vessel 6 through the discharge port 2d. The fluid discharged into the closed vessel 6 is discharged to the outside through a discharge pipe 6a. When the compressing action is produced in the compressing mechanism portion, a force tending to separate both scrolls 1 and 2 from each other is produced. However, the rear chamber 4b formed on the rear side of the orbiting scroll receives an intermediate pressure which is higher than the suction pressure but is lower than the discharge pressure, and the orbiting scroll 1 is pressed against the fixed scroll under the action of the intermediate pressure.

As described above, the compressing mechanism portion of the scroll compressor consists of the orbiting scroll 2 and the fixed scroll 1, each of which includes the base plate 10 and the spiral body 20 standing from the base plate. The shape of the spiral body of each of the orbiting scroll and the fixed scroll, according to the embodiment of the present invention as shown in FIGS. 2 and 3, is formed by an involute based on a circle having a radius which varies in accordance with an involute angle. That is, when a radius a of a base circle of an involute is expressed by a function of an involute angle $\lambda$, wherein:

$$a=f(\lambda), \tag{1}$$

the points on the involute are expressed by the following formulae;

$$X \leqq f(\lambda)\cos\lambda + f(\lambda)\lambda\sin\lambda \tag{2}$$

$$Y = f(\lambda)\sin\lambda - f(\lambda)\lambda\cos\lambda \tag{3}$$

In this case, the differential of f ($\lambda$) is expressed by the following formula;

$$f(\lambda)=df(\lambda)/d\lambda \tag{4}$$

If $f'(\lambda)>0$, the width between the lines of the involute is gradually increased toward the outer peripheral portion, as shown in FIG. 2, and if $f'(\lambda)<0$, the width between the lines is gradually decreased toward the outer peripheral portion.

In order to determine the shape of the wrap, it is required to determine the outside shape and the inside shape of the spiral body. According to this embodiment, the shape of the wrap is determined by the following procedure. Assuming that the radius of the base circle of the involute indicating the outside of the spiral body is $a_O$, and the radius of the base circle of the involute indicating the inside of the spiral body is $a_i$, the radius $a_O$ and the radius $a_i$ are expressed by the following formulae (5) and (6):

$$a_O=f(\lambda) \tag{5}$$

$$a_i=f(\lambda-\pi) \tag{6}$$

The shape of the spiral body as shown in FIG. 4 is so formed that the radius of the base circle of the involute expressing the inside shape of the spiral body is smaller, by $\pi$ relatively to the involute angle $\lambda$, than the radius of the base circle of the involute expressing the outside of the spiral body. That is, in the shape of the spiral body, as shown in FIG. 4, in which the radius a of the base circle a=f (Ap) is common to the outside and the inside of the spiral body, assuming that the involute angle of the point P on the outside of the spiral body is $\lambda_p$ and the involute angle of the point Q on the inside of the spiral body is $\lambda_g$, the shape of the spiral body is determined so as to satisfy the relation expressed by the following formula:

$$\lambda_g=\lambda_p+\pi: \tag{7}$$

The increment of the radius a of the base circle relative to the involute angle $\lambda$ is expressed by the formula (4). In case of the shape of the spiral body shown in FIG. 4 and FIG. 5, $f'(\lambda)<0$, that is, the radius a of the base circle is reduced toward the outside part of the spiral body where the involute angle $\lambda$ is increased. At this time, in order that the operating chamber be formed, it is required to form two spiral bodies 1 and 2 so that they can contact with each other at a plurality of contact points and the radius a of the base circle is so determined that the thickness of each of the spiral bodies 1 and 2 is gradually reduced toward the outside part thereof.

In the construction of the spiral bodies as described above, the phase difference $\pi$ exists and, therefore, even when the spiral body is formed by the involute of the circle having the radius which varies in accordance with the involute angle, it is possible to arrange the orbiting scroll and the fixed scroll so that they contact with each other at a plurality of contact points and have the lines connecting the contact points and the base circle to be common to the orbiting scroll and the fixed scroll and thus it is possible that the both scroll members provide seal points (or contact points) at the positions perpendicular to the side surfaces of the spiral bodies, respectively.

In the scroll type fluid machine as constructed above, as the orbiting scroll makes an orbiting movement, as shown in FIG. 6, the both scrolls operate, while holding a plurality of seal points therebetween at the same time, and after the seal point is formed at the outermost side a confined space is formed. The gas suctioned from the outside is confined into said confined space and then the volume of said confined space is gradually decreased, whereby the gas is compressed and then discharge from the central part.

In the above-described construction, if the volume of the confined space of the outermost chamber among the plurality of operating chambers formed between the spiral bodies (that is, the volume of the confined space which is formed immediately after the seal point has been formed at the outermost side) is set at an equal volume, the outer diameters of the both scrolls can be decreased as compared to the case where the conventional spiral body formed by the involute based on the circle having constant radius is used. Moreover, if it is assumed that the scroll having outer diameter of the same order is used, the number of windings can be increased, as compared to the case where the conventional spiral body formed by the involute based on the circle having constant radius is used. At this time, the thickness of the spiral body is decreased toward the outer peripheral portion and the volume changing ratio relative to the involute angle can be decreased, as shown in FIG. 8, in which the ratio of the confined volume of the confined space relative to the involute angle $\lambda$ of the seal point versus the confined volume of the smallest confined space is indicated, and such construction can be adapted to the use for more smooth operation. Furthermore, the thickness of the spiral body at the central portion where the pressure difference between the adjoining operating chambers which acts on the spiral body can be increased and, therefore, the strength of the spiral body can be increased and the amount of leakage can be decreased. With regard to the outer peripheral portion, it is not necessary to increase the thickness of the spiral body as in the central part and, therefore, the weights of the orbiting scroll and the fixed scroll can be reduced.

Then, the description will be given to the case where $f'(\lambda)>0$, that is the case where the radius of the base circle of the spiral body is gradually increased toward the outer side of the spiral body, with reference to FIG. 7. This case is similar to the case where $f'(\lambda)<0$. The orbiting scroll and the fixed scroll make contact at plurality of contact points, and lines connecting the contact points and the base circle are common to the both scrolls. However, in this case, the scrolls are so arranged that the thickness of the spiral body is gradually increased toward the outside portion of the spiral body. Accordingly, if the number of windings is assumed to be constant, the ratio of the confined volume at the outermost portion versus the confined volume at the innermost portion (built-in volume ratio) is increased, as compared to the conventional construction where the spiral body is formed by the involute having constant radius base circle, and thus the construction of the present invention is suitable to the use for the operation under higher compression ratio. In this case, the volume changing ratio to the involute angle $\lambda$ is decreased.

As described above, according to this embodiment, it is possible to select an optimum shape of the spiral body to provide proper stroke volume, built-in volume ratio, thickness of the spiral body or the like, depending upon object and use, such as desired strength, performance, reliability, productability or the like. The spiral bodies of the orbiting scroll and the fixed scroll can be machined according to the same machining program, that results in improving the productability. Since the phase difference $\pi$ exists, although the spiral body is formed by the involute based on a circle having a radius which varies in accordance with an involute angle, the orbiting scroll and the fixed scroll can be so arranged that these scrolls make contact at a plurality of contact points, respectively and include lines connecting the contact points with the base circle which are common to the orbiting scroll and the fixed scroll, and both scroll members have seal points at the positions which are perpendicular to the respective side surfaces of the spiral bodies. Accordingly, the present invention provides a scroll type fluid machine having an improved sealing property.

In the above description, the embodiment of the present invention has been described, with reference to the scroll type compressor which has the orbiting scroll, the fixed scroll, the suction part formed in the fixed scroll at the the outside of the orbiting scroll, the discharge port formed in the central part of the fixed scroll and the rotation preventing mechanism for preventing rotation of the orbiting scroll around its own axis thereby causing the orbiting scroll to produce orbital motion relatively to the fixed scroll. However, the present invention is not limited to this embodiment, and the invention may be adapted to the construction in which the orbiting scroll is moved through the positions where the crankshaft $\phi=0°$, $\phi=270°$, $\phi=180°$ and $\phi=90°$ in FIG. 6. In this construction, the orbiting scroll makes an orbital movement in the apposite of the wrap is determined as hereafter described. When the radius a of the base circle of the involute is expressed as a function of the involute angle $\lambda$, the radius a is expressed as a primary function:

$$\lambda a=f(\lambda)$$

$$=a_s+\Delta a\lambda \tag{8}$$

In this case, the shape of the outside line of the orbiting scroll is determined by the following formulae:

$$X_{mo}=f(\lambda)\cos\lambda+\{f(\lambda)+\tfrac{1}{2}(t_O+\Delta a\pi\lambda)\}\sin\lambda$$

$$Y_{mo}=f(\lambda)\sin\lambda-\{f(\lambda)\lambda+\tfrac{1}{2}(t_O+\Delta a\pi\lambda)\}\cos\lambda \tag{9}$$

and the shape of the inside line of the orbiting scroll is determined by the following formulae:

$$X_{mi}=f(\lambda-\pi)\cos\lambda+\{f(\lambda-\pi)\lambda-\tfrac{1}{2}(t_O+\Delta a\pi(\lambda-\pi)\}\sin\lambda$$

$$Y_{mi}=f(\lambda-\pi)\sin\lambda-\{f(\lambda-\pi)-\tfrac{1}{2}(t_O+\Delta a\pi(\lambda-\pi)\cos\lambda \tag{10}$$

When the shape of the scroll is determined as described above, it is possible to assemble two scrolls having same shape with a phase difference of 180°. In this case, the contact point between the both scrolls is formed on a tangential line of the base circle corresponding to the winding angle of said contact point. The same technical effect as explained with reference to FIGS. 1–8 can be achieved in this embodiment.

Figure 9:
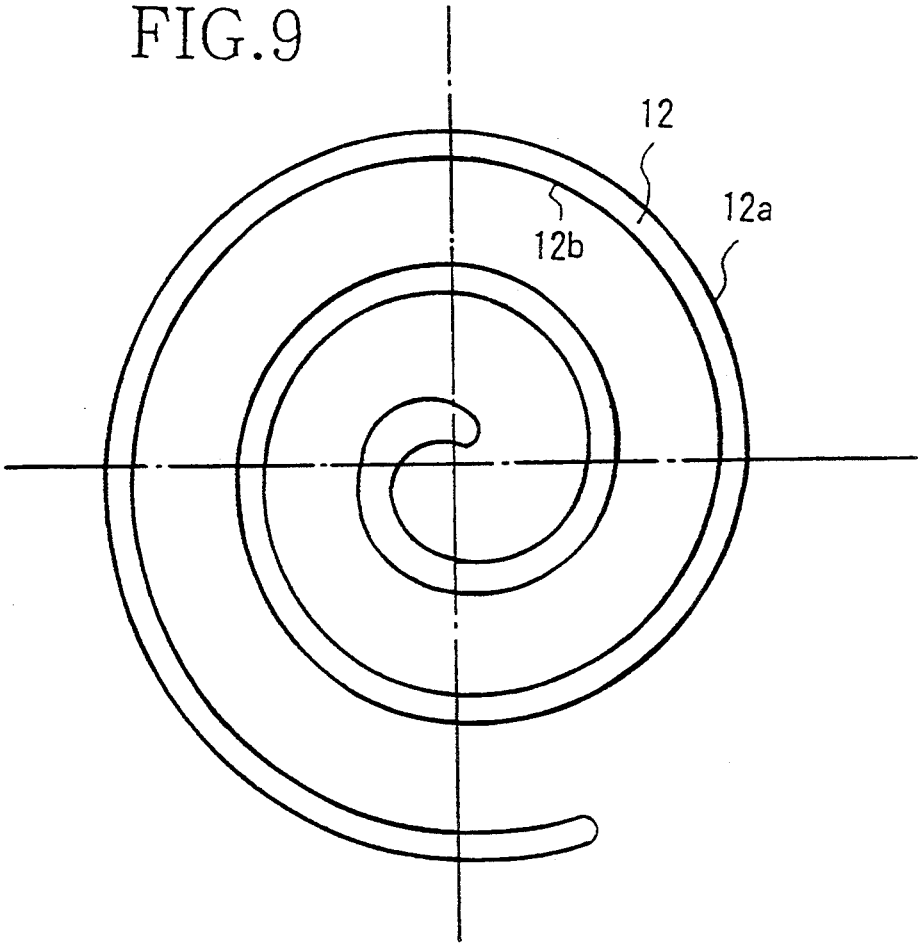
FIG. 9 is a plan view showing a shape of a spiral body according to another embodiment of the invention.
Figure 10:
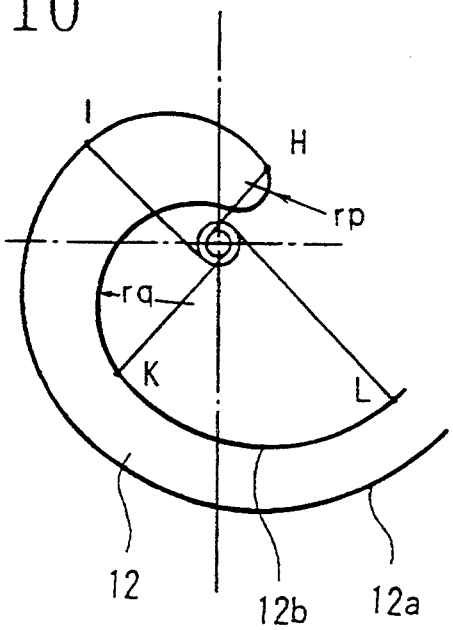
FIG. 10 is a plan view showing a shape of a central part of a spiral body.

According to the embodiment of FIGS. 9–12, the shape of the spiral body includes a portion which is formed by an involute based on circle having a radius which varies in accordance with an involute angle and another portion which is formed by an involute curve based on a circle having a constant radius. A starting end is formed by an arc. For example, the outside peripheral portion of the spiral body is formed by an involute curve based on a circle having a constant radius and the central portion is formed by an involute based on a circle having a radius which increases as an involute angle increases. An example is shown in FIG. 10, in which an outside surface 12*a* of the spiral body includes a portion extending from a point H to a point I which is formed by an involute based on a circle having a radius which increases as the involute angle increases and a portion extending from the point I to the outside which is formed by an involute curve based on a circle having a constant radius. An inside surface 12b of the spiral body includes a portion extending from a starting end to a point K which is formed by an arc, a portion extending from the point K to a point L which is formed by an involute based on a circle having a radius which increases as the involute angle increases and a portion extending from the point L to the outside which is formed by an involute curve based on a circle having a constant radius.

The portion which is formed by the involute based on the circle having the radius which increases as the involute increase is determined in the same angle manner as in the embodiment shown in FIGS. 2–6. Assuming that $a_O$ indicates a radius of a base circle of an involute expressing an outside of the spiral body and $a_i$ indicates a radius of a base circle of an involute expressing an inside of the spiral body, the radius $a_O$ and the radius $a_i$ are expressed by the formulae (5) and (6) and the radius of the base circle of the involute 12b expressing the inside shape of the spiral body is determined as a value which is smaller by $\pi$ relatively to the involute angle $\lambda$, as compared to the radius of the base circle of the involute 12a expressing the outside shape of the spiral body. That is, in the shape of the spiral body as shown in FIGS. 9 and 10, the involute angle $\lambda_p$ of the point P on the outside of the spiral body and the involute angle $\lambda_g$ of the point Q on the inside of the spiral body, which commonly involve the radius a of the base circle $a=f(\lambda p)$, are determined so as to satisfy the relationship expressed by the formula (7), with $f'(\lambda)$ expressed by the formula (4) being determined as $(\lambda)>0$.

According to the embodiment of FIGS. 9–12, which is the radius of the base circle of the involute which forms the spiral body continuously changes from the area where the radius varies in accordance with the involute angle to the area which has the constant radius, and it is possible to increase the thickness of the wrap at the central part of the spiral body, without changing the shape of the outer peripheral portion; therefore, the strength of the spiral body can be improved and the amount of leakage can be reduced. Furthermore, the confined volume ratio can be altered and the flexibility in design can be increased.

Figure 11:
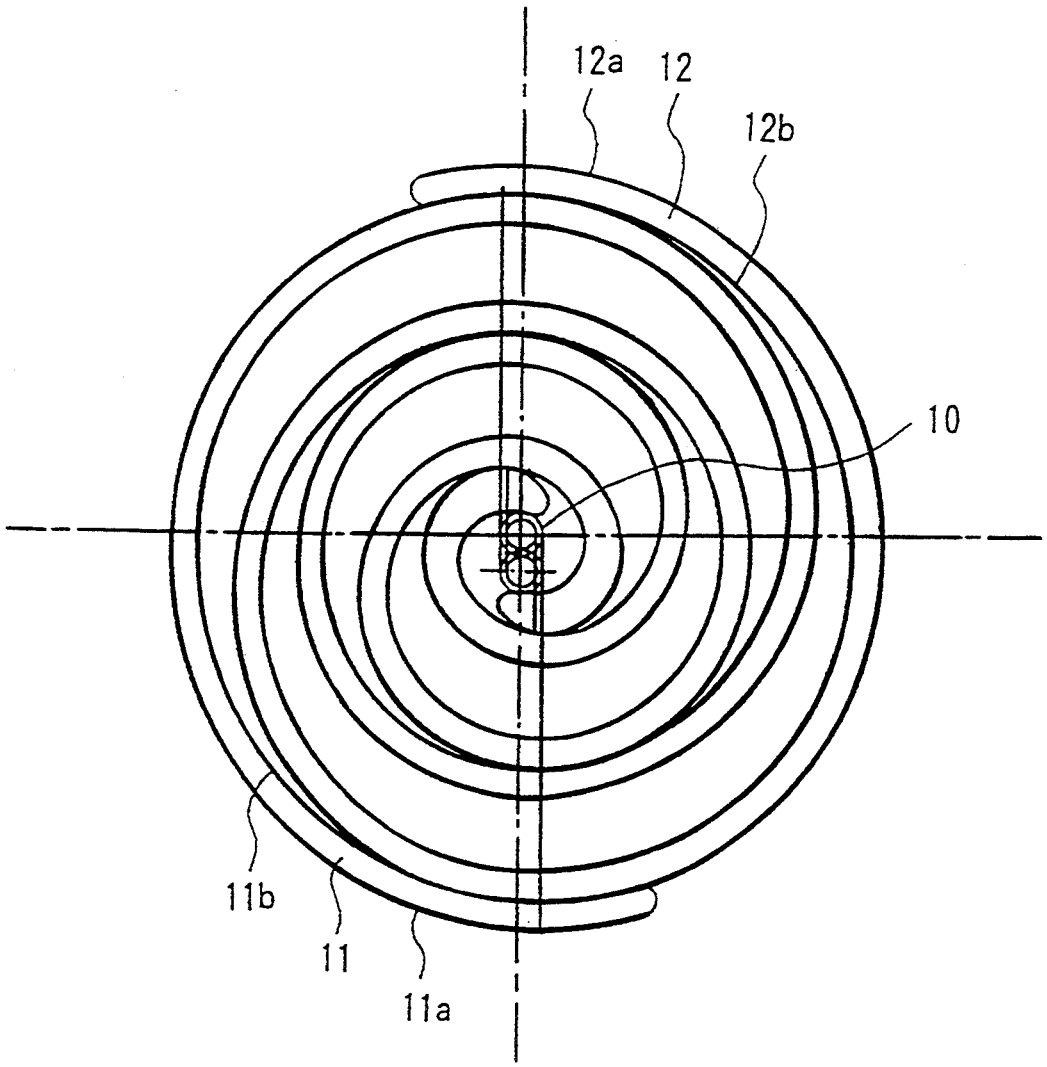
FIG. 11 is a plane view showing spiral bodies which are assembled together.

In order that the operating chamber be formed under the state where the spiral bodies are assembled with each other, as shown in FIG. 11, it is necessary to arrange two spiral bodies 11 and 12 so that they contact with each other at a plurality of contact points. According to the construction of the present invention, the phase difference $\pi$ relative to the involute angle $\lambda$ exists between the inside involute and the outside involute of the spiral body, as described above, and, therefore, a pair of scrolls can be so arranged that they make contact at a plurality of contact points, respectively, and they have a line connecting the contact point and the base circle which are common to the both scrolls, and the both scrolls have seal points (or contact points) at the perpendicular positions to the respective side surfaces.

In the scroll type fluid machine as constructed above, the both scrolls operate while they hold a plurality of seal points at the same time. As shown in FIG. 10, the starting end of the spiral body has the shape which includes an outside convex portion formed by the arc having radius $r_p$ and an inside concave portion formed by an arc having a radius $r_q$, and the shape of the spiral body is formed so as to satisfy the relationship $r_p+\epsilon=r_q$, where $\epsilon$ is the radius of the orbital motion. Therefore, a pair of spiral bodies have seal points from their starting ends and it is possible to increase the confined volume ratio.

Figure 12:
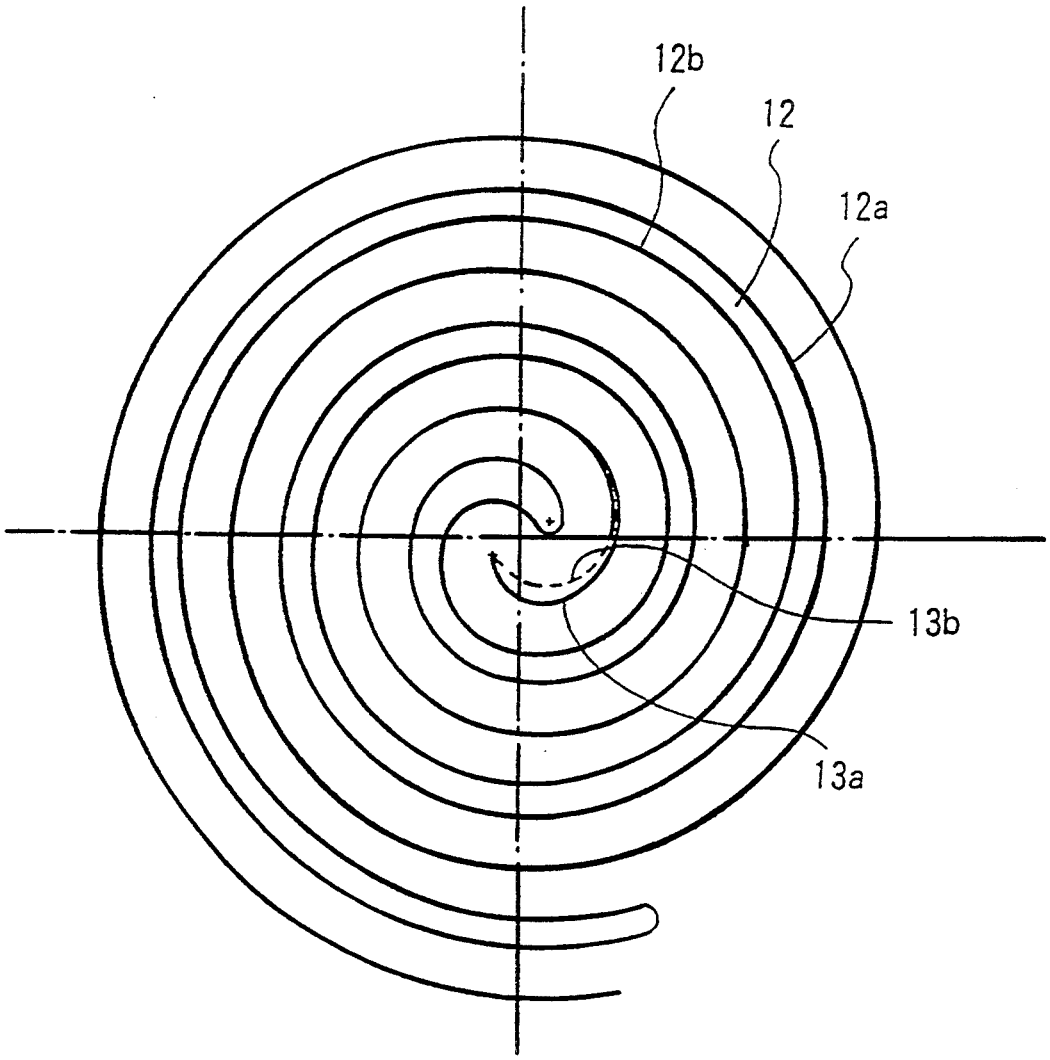
FIG. 12 is a plan view showing a locus of a center of an end mill.
Figure 13:
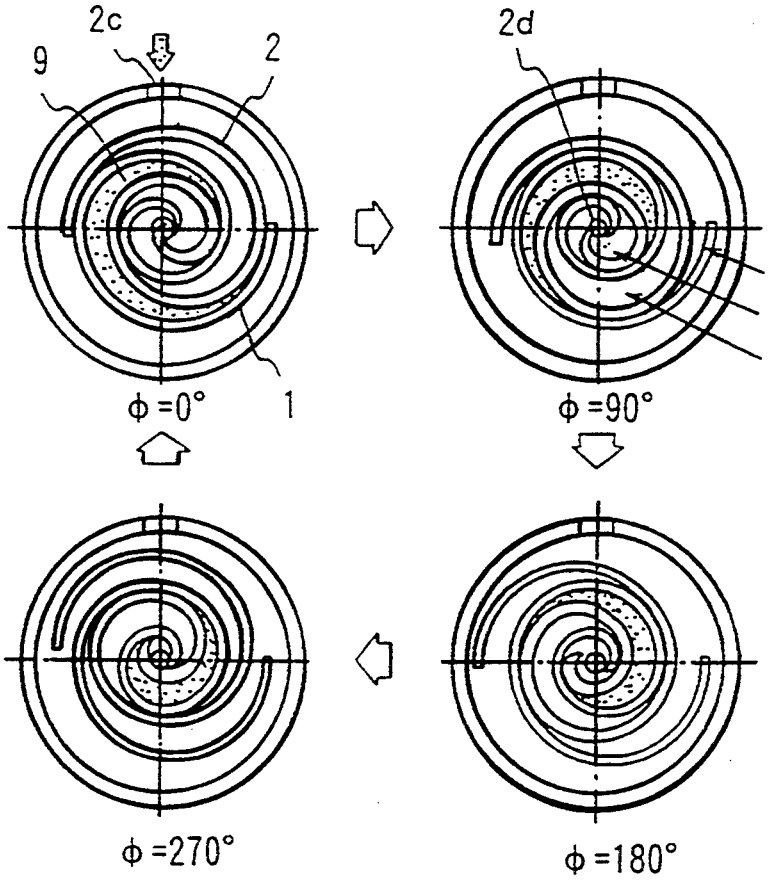
FIG.13 PRIOR ART
FIG. 13 is a plan view showing a principle of operation of a conventional scroll type fluid machine.

Now description will be given to a locus of an end mill which is used to machine the spiral body according to the above-described embodiment, with reference to FIG. 12. The portion of the outside which is formed by the circle having a constant radius constitutes a main part of the spiral body which is uniformly formed, so that the machining of the bottom of the groove can be effected by one machining step, however, if necessary the machining may be effected by two machining steps. At the central part of the spiral body which is formed by an involute based on a circle having a radius which varies in accordance with an involute angle, the width of groove of the spiral body successively varies and, therefore, it is impossible to machine the bottom of the groove by a single machining step. It is necessary to effect two step machining, that is machining steps effected by moving the center of the end mill along the locus indicated by a solid line 13a and along the locus indicated by a broken line 13b to form the outside portion and the inside portion of the width of the spiral body. According to the embodiment as described above, the substantial portion of the spiral body has a constant groove width and the portion which requires two step machining is limited to the central part. Accordingly, the spiral body can be produced by simple operation.

As described above, the present invention provides a scroll type fluid machine in which a spiral body of the scroll is formed by an involute based on a circle having a radius which varies in accordance with an involute angle. Accordingly, it is possible to make a spiral body which has a volumetric change depending on the use, even if any dimensional limitation exists, and thus the freedom in design is improved. Furthermore, it is possible to form a spiral body having an optimum shape in view of its strength, performance, reliability, productability or the like, depending upon use and object of the scroll type fluid machine. It is possible to machine the spiral bodies of the orbiting scroll and the fixed scroll according to the same machining program and thus good productivity can be achieved. The phase difference $\pi$ exists and, therefore, although the spiral body is formed by an involute based on a circle having a radius which varies in accordance with an involute angle, it is possible to form the orbiting scroll and the fixed scroll so that they contact with each other at a plurality of contact points and have a line connecting the contact point and the base circle which is common to the both scrolls. These scroll members have seal points at the positions perpendicular to the respective side surfaces and, therefore, a scroll type fluid machine having good sealing property is obtained.

What is claimed is:

1. A scroll type fluid machine including two scroll members, each having a spiral body formed on a base plate, with the scroll members being arranged to mesh with each other to form a confined space therebetween, one of said scroll members being arranged to make an orbiting movement relative to the other scroll member to successively enlarge or reduce said confined space to expand or contract a fluid confined in said confined space, wherein said spiral body has a shape formed by an involute based on a circle having a radius which varies in accordance with an involute angle, and wherein an outer line and an inner line of said spiral body have phase differences relative to said involute angle.

2. A scroll type fluid machine including two scroll members each having a spiral body formed in a base plate, with the scroll members being arranged to mesh with each other to form a confined space therebetween, one of said scroll members being arranged to make an orbiting movement relative to the other scroll member to successively enlarge or reduce said confined space to expand or contract fluid confined in said confined space, wherein said spiral body has a shape formed by an involute based on a circle having a radius which varies in accordance with an involute angle, and wherein the shapes of the spiral bodies of the meshing scrolls are at least partly formed in a substantially same shape.

3. A scroll type fluid machine including two scroll members, each having a spiral body formed on a base plate, with each of the scroll members being arranged to mesh with each other to form a confined space therebetween, one of said scroll members being arranged to make an orbiting movement relative to the other scroll member to successively enlarge or reduce said confined space to expand or contract a fluid confined in said confined space, wherein said spiral body has a shape formed by an involute based on a circle having a radius which varies in accordance with an involute angle, and wherein an outside shape and an inside shape of said spiral body are formed so as to satisfy the following relationships:

$$a_o=f(\lambda),\ a_i=f(\lambda-\pi)$$

where:

$a_o$=a radius of base circle of involute which forms outside shape of the spiral body, $a_i$=a radius of base circle of involute which forms inside shape of the spiral body, $\lambda$=an involute angle.

4. A scroll type fluid machine including two scroll members, each having a spiral body formed on a base plate, with each of the scroll members being arranged to mesh with each other to form a confined space therebetween, one of said scroll members being arranged to make an orbiting movement relative to the other scroll member to successively enlarge or reduce said confined space to expand or contract a fluid confined in said space, wherein said spiral body has a shape formed by an involute based on a circle having a radius which varies in accordance with an involute angle, and wherein said spiral body is formed so as to satisfy the following relationships:

assuming that a is a radius of a base circle of the involute which forms the shape of the spiral body, $\lambda$ is an involute angle and the involute is expressed by X-coordinate and Y-coordinate, the radius of base circle is $$a=f(\lambda)=a_s+\Delta a\lambda,$$

the shape of outer line of spiral body is $$X_{mo}=f(\lambda)\cos\lambda+\{f(\lambda)\lambda+\tfrac{1}{2}(t_o+\Delta a\pi\lambda)\}\sin\lambda,$$

$$Y_{mo}=f(\lambda)\sin\lambda-\{f(\lambda)\lambda+\tfrac{1}{2}(t_o+\Delta a\pi\lambda)\}\cos\lambda,\text{ and}$$

the shape of inner line of spiral body is $$X_{mi}=f(\lambda-\pi)\cos\lambda+\{f(\lambda-\pi)\lambda-\tfrac{1}{2}(t_o+\Delta a\pi(\lambda-\pi)\}\sin\lambda,$$

$$Y_{mi}=f(\lambda-\pi)\sin\lambda-\{f(\lambda-\pi)\lambda-\tfrac{1}{2}(t_o+\Delta a\pi(\lambda-\pi)\}\cos\lambda.$$

5. A scroll type fluid machine including two scroll members, each having a spiral body formed on a base plate, with each of the scroll members being arranged to mesh with each other to form a confined space therebetween, one of said scroll members being arranged to make an orbiting movement relative to the other scroll member to successively enlarge or reduce said confined space to expand or contract a fluid in said confined space, wherein said spiral body has a shape formed by an involute based on a circle having a radius which varies in accordance with an involute angle, and said spiral body is formed so as to satisfy the following relationships:

assuming that an outer line of the spiral body and an inner line of the spiral body have a common radius of base circle $a_o=f(\lambda_p)$, and an involute angle of a point P on the outer line is $\lambda_p$ and an involute angle of a point Q on the inner line is $\lambda_g'$ $$\lambda_g=\lambda_p+\pi.$$

6. A scroll type fluid machine including two scroll members, each having a spiral body formed on a base plate, with said scroll members being arranged to mesh with each other to form a confined space therebetween, one of said scroll members being arranged to make an orbiting movement relative to the other scroll member to successively enlarge or reduce said confined space to expand or contract a fluid confined in said confined space, wherein said spiral body has a shape formed by an involute based on a circle having a radius which varies in accordance with an involute angle, and wherein lines connected a plurality of contact points and said base circle are common to both of said scrolls.

7. A scroll type fluid machine in accordance with claim 1 wherein said spiral body is formed such that a groove width between the spiral bodies and a thickness of the spiral bodies vary in accordance with an involute angle and the shapes of the spiral bodies of the meshing scroll members are formed in a substantially same shape.

8. A scroll type fluid machine including two scroll members, each having a spiral body formed on a base plate, with said scroll members being arranged to mesh with each other to form a confined space therebetween, one of said scroll members being arranged to make an orbiting movement relative to the other scroll member to successively enlarge or reduce said confined space to expand or contract a fluid confined in said space, wherein said spiral body has a shape formed by an involute based on a circle having a radius which varies in accordance with an involute angle, and said spiral body is formed such that a part of the shape is formed so as to vary a groove width between the spiral bodies and a thickness of the spiral body vary in accordance with an involute angle which the remaining part of the shape is formed so as to provide constant groove width and constant thickness relative to the involute angle.

9. A scroll type fluid machine including two scroll members, each having a spiral body formed on a base plate, each of said scroll members being arranged to mesh with each other to form a confined space therebetween, one of said scroll members being arranged to make an orbiting movement relative to the other scroll member to successively enlarge or reduce said confined space to expand or contract a fluid confined in said confined space, wherein said spiral body is so formed that a part of the shape of the shape of said spiral body is formed by an involute based on a circle having a radius which varies in accordance with an involute angle while the remaining part is formed by an involute based on a circle having a constant radius relative to an involute angle of the spiral body.

10. A scroll type fluid machine according to claim 1, wherein the inside shape and the outside shape of said spiral body consist of involutes based on circles having different radii at a same involute angle, respectively.

11. A scroll type fluid machine according to claim 10, wherein the spiral body is formed so as to satisfy the following relationships:

$$a_o = f(\lambda),$$

$$a_i = f(\lambda - \pi),$$

where:

$a_o$=a radius of base circle of involute which forms outside shape of the spiral body, $a_i$=a radius of base circle of involute which forms inside shape of the spiral body, and $\lambda$=an involute angle.

12. A scroll type fluid machine according to one of claims 1–6, 10 and 11, wherein said spiral body is formed so as to satisfy the following relationships:

$$\frac{da}{d\lambda} = \frac{df(\lambda)}{d\lambda} = f'(\lambda),$$

where:

a=a radius of base circle of said involute, $\lambda$=an involute angle, $f'(\lambda)$=an increment of radius of the base circle relative to the involute angle, and wherein the increment $f'(\lambda)$ of the radius a of the base circle relative to the involute angle $\lambda$ through at least a part of starting end to terminating end of the spiral body satisfies the following relation:

$$f'(\lambda) < 0.$$

13. A scroll type fluid machine according to one of claims 1–6, 10 and 11, wherein said spiral body is formed so as to satisfy the following relationships:

$$\frac{da}{d\lambda} = \frac{df(\lambda)}{d\lambda} = f'(\lambda),$$

where:

a=a radius of base circle of said involute, $\lambda$=an involute angle, $f'(\lambda)$=an increment of radius of the base circle relative to the involute angle, and wherein the increment $f'(\lambda)$ of the radius a of the base circle relative to the involute angle $\lambda$ through the whole or a part of starting end to terminating end of the spiral body satisfies the following relationship:

$$f'(\lambda) < 0.$$

14. A scroll type fluid machine according to claim 8 or claim 9, wherein a part of the shape of said spiral body is formed at the starting end side of the spiral body.

15. A scroll type fluid machine according to claim 13, wherein the outside concave portion of the starting end of said spiral body is formed by an arc having a radius $r_p$, the inside convex portion thereof is formed by an arc having a radius $r_g$, and the orbital motion has a radius of motion $\epsilon$, and these factors have substantially the following relationship:

$$r_q = \epsilon + r_p.$$

* * * * *